United States Patent [19]

Bronicki

[11] 4,428,190

[45] Jan. 31, 1984

[54] POWER PLANT UTILIZING MULTI-STAGE TURBINES

[75] Inventor: Lucien Y. Bronicki, Rehovot, Israel

[73] Assignee: Ormat Turbines, Ltd., Yavne, Israel

[21] Appl. No.: 291,084

[22] Filed: Aug. 7, 1981

[51] Int. Cl.[3] ..... F01K 3/00; F01K 23/02

[52] U.S. Cl. ..... 60/655; 60/652; 60/659; 60/677

[58] Field of Search ..... 60/652, 655, 659, 677

[56] References Cited

U.S. PATENT DOCUMENTS

| | | | |
|---|---|---|---|
| 3,411,299 | 11/1968 | Nettel | 60/652 |
| 3,416,318 | 12/1968 | Chocquet | 60/677 X |
| 4,089,744 | 5/1978 | Cahn | 60/652 X |
| 4,129,004 | 12/1978 | Thelen et al. | 60/659 X |
| 4,347,706 | 9/1982 | Drost | 60/659 |

FOREIGN PATENT DOCUMENTS

| | | | |
|---|---|---|---|
| 1959725 | 6/1970 | Fed. Rep. of Germany | 60/659 |
| 7323455 | 1/1975 | France | 60/655 |
| 261368 | 11/1926 | United Kingdom . | |
| 267012 | 3/1927 | United Kingdom . | |
| 296023 | 7/1929 | United Kingdom . | |
| 964216 | 7/1964 | United Kingdom . | |
| 1242627 | 8/1971 | United Kingdom . | |
| 2049816 | 12/1980 | United Kingdom . | |

*Primary Examiner*—Allen M. Ostrager
*Attorney, Agent, or Firm*—Sandler & Greenblum

[57] ABSTRACT

A power plant includes a steam boiler that delivers a rated amount of high-pressure steam at rated temperature and pressure to a steam turbine having a high-pressure stage and at least one low-pressure stage driven by low-grade steam exhausted from the high-pressure stage. A main generator, driven by the steam turbine, furnishes electricity to a variable load. When the load decreases below rated value, the boiler operation is maintained, but low-grade steam exhausted from the high-pressure stage of the turbine is diverted from the low-pressure stage to a heat store large enough to accumulate heat during the time that the power plant operates at less than rated load. A waste heat converter, having its own generator, is responsive to the low-grade heat stored in the heat store, and can be operated selectively to furnish electricity to the load to supplement the output of the power plant. The output of the waste heat converter can be used for peak-power purposes, thereby reducing the size of the main power plant, as well as for furnishing low-level power during shutdown of the main power plant. Moreover, when in operation, the boiler and the high-pressure stage of the turbine operate at peak efficiency, which results in reducing the fuel cost of the power plant.

3 Claims, 5 Drawing Figures

POWER PLANT UTILIZING MULTI-STAGE TURBINES

DESCRIPTION

1. Technical Field

The present invention relates to an improved power plant utilizing a multi-stage turbine hereinafter termed a power plant of the type described wherein the output of one stage constitutes the input to the succeeding stage.

2. Background Art

In many industrial power plants of the type described cyclical electrical loads are accommodated by controlling either the rate at which steam is produced by the boiler or the inlet pressure to the turbine stages. When the electrical load on the power plant is the rated output thereof, the boiler generates steam at rated temperature, pressure, and mass flow. On the other hand, when the electrical load on the power plant decreases below rated value, the turbine output must be reduced. Because the peak turbine efficiency occurs at rated load, any operation at less than rated load adversely affects the cost of electrical power produced by the power plant. In addition, the conventional approach to reducing turbine output introduces further inefficiencies into the overall system. Thus, reducing the turbine inlet pressure (throttling) in order to reduce turbine output introduces an irreversible process that wastes fuel; and operating the boiler at less than its designed condition in order to reduce mass flow also results in less efficient use of fuel.

It is, therefore, an object of the present invention to provide a new and improved power plant of the type described which overcomes or substantially reduces the deficiencies described above.

DISCLOSURE OF INVENTION

In a power plant according to the present invention, a steam boiler is operated to deliver a rated amount of high-pressure steam at rated temperature and pressure to a steam turbine having a high-pressure stage and at least one low-pressure stage driven by low-grade steam exhausted from the high-pressure stage. A main generator, driven by the steam turbine, furnishes electricity to a variable load. When the load decreases below rated value, the boiler operation is maintained, but low-grade steam exhausted from the high-pressure stage of the turbine is diverted from the low-pressure stage to a heat store, such as a volume of water, large enough to accumulate the heat in the low-pressure steam during the time that the power plant operates at less than rated load. A waste heat converter, having its own generator, is responsive to the low-grade heat stored in the heat store, and can be operated selectively to furnish electricity to the load to supplement the output of the power plant. The output of the waste heat converter can be used for peak-power purposes, thereby reducing the size of the main power plant, as well as for furnishing low-level power during shutdown of the main power plant. Moreover, when in operation, the boiler and the high-pressure stage of the turbine operate at peak efficiency, which results in reducing the fuel cost of the power plant according to the present invention below the fuel cost of a conventional power plant of the same size.

BRIEF DESCRIPTION OF THE DRAWINGS

An embodiment of the invention is shown in the accompanying drawings, wherein.

DETAILED DESCRIPTION

Figure 1:
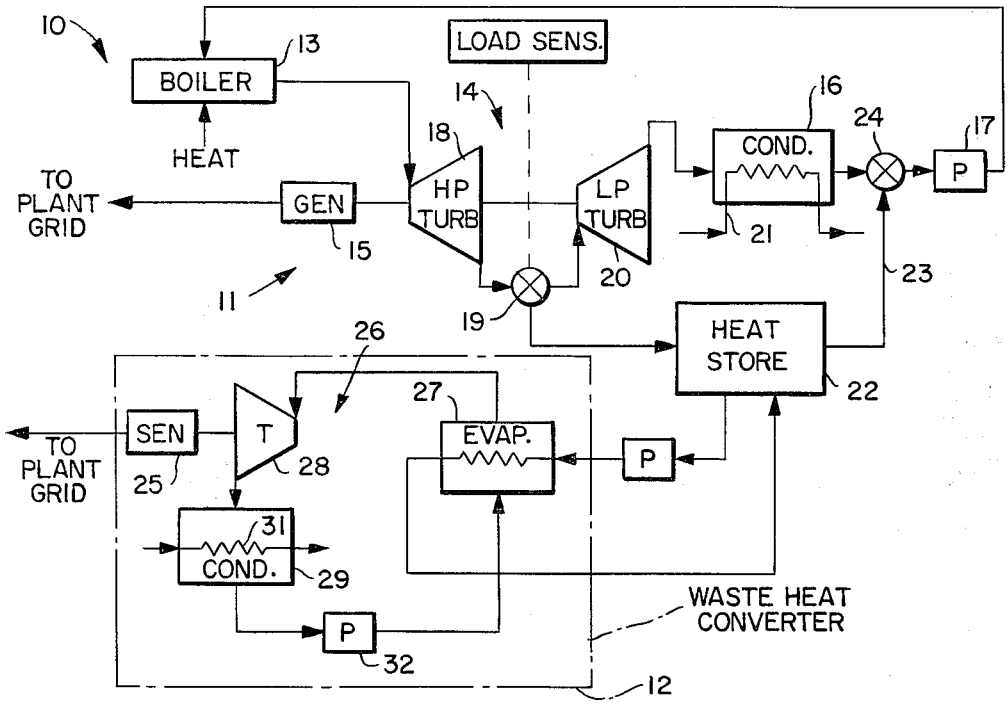
FIG. 1 is a block diagram of a power plant of the type described, into which the present invention is incorporated.

Referring now to FIG. 1 of the drawings, reference numeral 10 designates a power plant according to the present invention comprising power plant 11 of the type described to which waste heat converter 12 is connected. Power plant 11 comprises conventional steam boiler 13, multi-stage steam turbine 14 driving generator 15 that supplies electricity to a plant grid (not shown), condenser 16, and feed pump 17. Heat supplied to boiler 13 allows the boiler to furnish high-pressure steam to high-pressure turbine stage 18, the exhaust of which is applied via valve 19 to low-pressure steam turbine 20, which exhausts into condenser 16. Cooling water supplied through coils 21 cools the exhaust from the low-pressure turbine 20, and the resultant liquid water is transferred by pump 17 back into the boiler, thus completing the cycle.

When rated heat is supplied to boiler 13, it will produce rated mass flow of steam at rated temperature and pressure; and power plant 11 operates so that generator 15 supplies rated power to the grid of a plant being supplied by the power plant. Under this condition, turbine 14 operates at its design point, and its efficiency, as well as the efficiency of the entire power plant, will be at a maximum. When the load supplied by generator 15 decreases below the rated value, the conventional approach for reducing the output of turbine 14 is to throttle the steam applied to the high-pressure turbine, and perhaps to throttle the steam applied to the low-pressure turbine. This will reduce the amount of work produced by the turbine, but its efficiency will also drop. In addition to the losses occasioned by this decrease in efficiency of the turbine when it operates at a condition other than its rated load, the throttling introduced into the steam lines represents an irreversible process that further reduces the efficiency of the power plant. As a consequence, the fuel component of the cost of electricity produced by the power plant will increase whenever the system operates above or below rated conditions.

To overcome this inefficient operation when the system load is different from the rating of the power plant, waste heat converter 12 and heat store 22 are incorporated into power plant 11. Specifically, heat store 22 may be in the form of a large volume of water which is heated when selectively operable bypass valve 19 is switched from low-pressure turbine 20 to heat store 22. That is to say, when valve 19 switches the low-pressure steam exhausted from high-pressure turbine 18 from low-pressure turbine 20 to heat store 22, the heat contained in the low-pressure steam is transferred to the water contained in heat store 22 instead of being converted into work by low-pressure turbine 20.

If desired, the operation of valve 19 can be automated. In such case, load sensor 40, responsive to the output of generator 15, could produce a control signal that causes valve 19 to divert flow from turbine 20 to store 22 in response to a predetermined reduction in load on power plant 11.

The volume of water added to heat store 22 by the selective operation of bypass valve 19 is removed from the heat store via line 23 connected to mixing valve 24 by operation of feed pump 17. Thus, the flow of water to boiler 13 is maintained. In this manner, both high-pressure steam turbine 18 and boiler 13 continue to operate at their design conditions, thus maximizing the efficiency of these two components. Heat not used in turbine 14 is thus accumulated in store 22.

Figure 2:
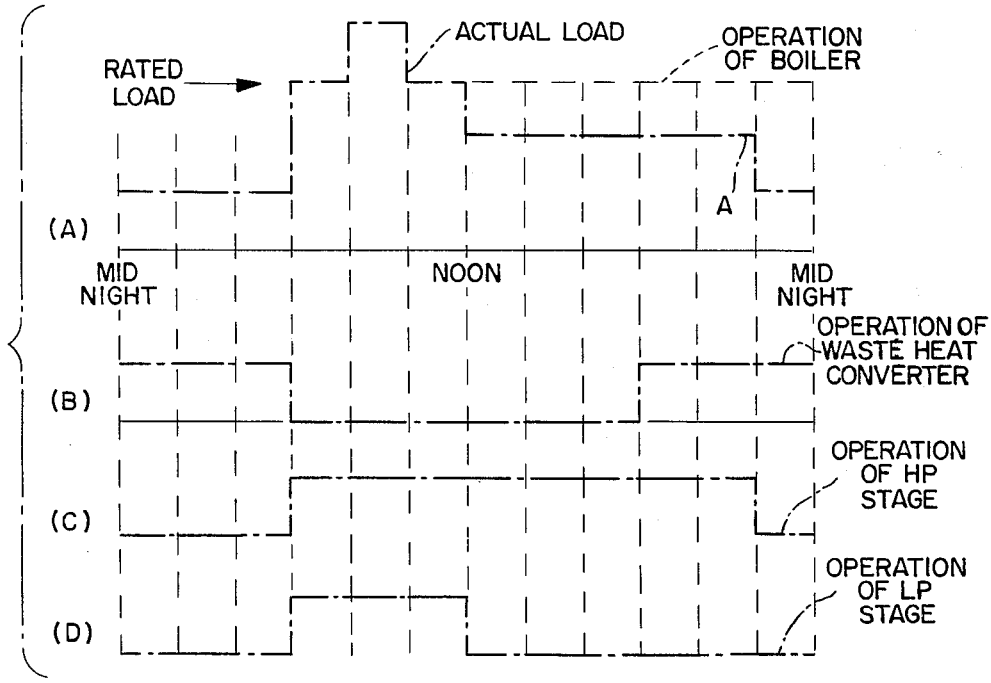
FIGS. 2A–2D are time diagrams illustrating the variation in load and the operation of the boiler and the waste heat converter.

The condition described above is illustrated in FIG. 2, wherein curve A of FIG. 2A represents the time variation of the load during a typical 24-hour period, it being understood that curve A is merely illustrative of a typical demand curve for a plant grid. In the situation illustrated, power plant 10 is required to furnish rated load for about two hours, from about 10:00 a.m. to about 12:00 noon; and, for the next ten hours, power plant 10 is required to furnish less than rated load. Assuming that the load to be furnished by power plant 10 during the interval from noon until 10:00 p.m. is the rated output of high-pressure stage 18 of turbine 14, the excess heat produced by boiler 13, instead of being converted by low-pressure stage 20 into work, is diverted by the operation of bypass 19 to heat store 22. Thus, for the next ten hours boiler 13 and turbine 18 continue to operate at peak efficiency.

At about 10:00 p.m., when the load to be furnished by power plant 10 drops to its lowest level, which, in the illustration in FIG. 2, is the capacity of waste heat generator 25, operation of boiler 13 is suspended, and waste heat converter 12 is operated.

As shown in FIG. 1, waste heat converter 12 preferably comprises closed Rankine-cycle organic fluid power plant 26 in the form of evaporator 27, organic fluid turbine 28, and condenser 29. In initiating the operation of waste heat converter 12, pump 32 is turned on for the purpose of drawing hot water from heat store 22 and passing this water through heat exchanger 30 in the evaporator. An organic fluid, such as Freon or the like, contained in evaporator 27 is evaporated by the heated water, and converted into a vapor which is supplied to the inlet of organic fluid turbine 28, which drives generator 25 in a conventional manner. The vapor exhausted from turbine 28 is supplied to condenser 29, where cooling water passing through coils 31 condenses the vapors exhausted by turbine 28; and feed pump 32 returns the condensed organic fluid to evaporator 27 for completing the cycle.

By reason of the operation of boiler 13 during the period of time when the load on power plant 10 is below the rated load, sufficient heat is stored in heat store 22 to permit waste heat converter 12 to operate from about 10:00 p.m. until about 6:00 a.m. the next morning, supplying the requirements of the plant grid from the output of generator 25. At about 6:00 a.m., operation of waste heat converter 12 is terminated by disabling pump 32 and operating valve 19 such that the exhaust of turbine 18 is applied to the inlet of turbine 20 at the same time that power plant 11 is brought back into operation by supplying heat to boiler 13. Thus, the energy furnished by power plant 10 is diverted from generator 25 to generator 15, and the rated load is again furnished by the power plant.

As shown in FIG. 2, at about 8:00 a.m., the actual load to be supplied by power plant 10 peaks for about two hours; and during this peaking time, waste heat converter 12 is again brought back into operation so that generators 15 and 25 simultaneously supply energy to the plant grid.

The curve in FIG. 2B indicates the period of time during which waste heat converter 12 is operated, while the curve in FIG. 2C indicates the operational period of the high-pressure stage of turbine 18. Finally, the curve of FIG. 2D indicates the period of time during which the low-pressure stage of the turbine is operated. The result of the operation of the waste heat converter and the operation of the stages of multi-stage turbine 14 produces the load characteristic indicated by curve A in FIG. 2.

Heat store 22 can be an open tank of water arranged so that low-pressure steam exhausted from high-pressure turbine 18 is brought into direct contact with the water in the heat store. Alternatively, the heat store can be a liquid other than water, and heat can be transferred from the low-pressure steam into the heat storage liquid by a suitable heat exchanger (not shown).

While a closed Rankine-cycle organic fluid power plant is illustrated in FIG. 1, other types of power plants could also be utilized. For example, a low-pressure steam turbine could be utilized as part of the waste heat converter; and in such case, the evaporator could be in the form of a flash evaporator which would admit water drawn from heat store 22 to be flashed into steam, which would then be supplied to a steam turbine driving generator 25.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

What is claimed is:

1. An integrated power plant comprising:

(a) a steam boiler operable to deliver a rated amount of high-pressure steam at rated temperature and pressure to a steam turbine having a high-pressure stage and at least one low-pressure stage driven by low-grade steam exhausted from the high-pressure stage;

(b) a main generator driven by the steam turbine for furnishing the electricity to a variable load;

(c) a heat store containing water for storing low-grade heat;

(d) actuatable means for selectively diverting said low-grade steam into the water of the heat store for heating the same;

(e) a feed pump for removing water from the heat store and inputting it into the boiler, sufficient water being removed from the heat store to maintain the steam output of the boiler at its rated value; and (f) a waste heat converter responsive to low-grade heat in the heat store for furnishing electricity to the variable load.

2. An integrated power plant according to claim 1 wherein the waste heat converter is a closed Rankine-cycle organic fluid power plant.

3. An integrated power plant according to claim 2 including means for monitoring the electrical load and automatically actuating said actuatable means for selectively diverting low-grade steam to the heat storage in response to the level of the electrical load.

* * * * *